United States Patent [19]

Kamitani

[11] Patent Number: 4,750,019

[45] Date of Patent: Jun. 7, 1988

[54] ELECTROPHOTOGRAPHIC APPARATUS

[75] Inventor: Yutaka Kamitani, Hyogo, Japan

[73] Assignee: Sanyo Electric Co. Ltd., Japan

[21] Appl. No.: 74,417

[22] Filed: Jul. 16, 1987

[30] Foreign Application Priority Data

Jul. 17, 1986 [JP] Japan ..... 61-110514[U]

[51] Int. Cl.[4] ..... G03G 15/00

[52] U.S. Cl. ..... 355/14 CH; 355/3 CH

[58] Field of Search ..... 355/3 R, 3 CH, 14 CH, 355/14 R

[56] References Cited

U.S. PATENT DOCUMENTS

| | | | |
|---|---|---|---|
| 4,470,693 | 9/1984 | Dolan | 355/15 |
| 4,542,981 | 9/1985 | Anzai et al. | 355/14 CH X |
| 4,678,317 | 7/1987 | Grossinger | 355/14 CH X |
| 4,695,723 | 9/1987 | Minor | 355/14 CH X |

*Primary Examiner*—A. C. Prescott

*Attorney, Agent, or Firm*—Darby & Darby

[57] ABSTRACT

An electrophotographic apparatus adopts the reversal developing system where an electrostatic latent image charged in the positive polarity on the surface of a photosensitive drum by toner charged in the same positive polarity. The photosensitive drum is composed of Se series or OPC (organized photo-conductor) series material, and a discharging light source and a charging corotron which are installed in a common cover are disposed on the peripheral side surface of the photosensitive drum. The charging corotron is disposed downstream from the discharging light source in a direction of rotation of the photosensitive drum. In the common cover, a partition through which part of light of the discharging light source leaks to an area charged by the charging corotron is installed between the discharging light source and the charging corotron. Accordingly, on part of the surface of the photosensitive drum, discharging and charging are performed in an overlapped manner.

4 Claims, 1 Drawing Sheet

ELECTROPHOTOGRAPHIC APPARATUS

BACKGROUND OF THE INVENTION

1. Field of the Invention

The present invention relates to an electrographic apparatus. More specifically, the present invention relates to an electrographic apparatus of reversal developing system wherein discharging or erasing is performed by a discharging light source such as an eraser lamp, and thereafter a surface of a photosensitive member is charged and exposed, and is further developed by toner, and thereafter a sub-charging process such as transfer charging is formed.

2. Description of the Prior Art

One example of an electrographic apparatus of this type is disclosed, for example, in the Japanese Patent Laid-Open No. 104961/1982. In this prior art, movable shield plates are installed at both ends of a transferring corotron so that effective width of discharge of the transferring corotron can be changed in accordance with paper size, and thereby influence of remaining charge of reverse polarity due to the transferring corotron is eliminated.

Also, in another electrographic apparatus disclosed in the Japanese Patent Laid-Open No. 180575/1984, a further charging corotron other than a main charging corotron is installed downstream from the transferring corotron. This charging corotron is for restoring surface potential of the portion of the photosensitive member charged in the reverse polarity by passing through the transferring corotron to the normal potential.

In the first prior art, the effective discharge area of the transferring corotron, that is, the effective transfer area in a direction of width of the surface of the photosensitive drum can be controlled, but control in the direction of advance of the photosensitive drum, that is, in the direction of rotation thereof cannot be performed. This means that even when a plurality of copies are made continuously, intervals are kept without fail between the transfer papers for control, for example, for peeling the transfer papers from the surface of the photosensitive drum. This interval becomes a portion where the transfer paper does not adhere to the surface of the photosensitive drum and the surface of the photosensitive drum passes through the transferring corotron while exposed. Then, the exposed portion is charged by discharge of the transferring corotron, for example, in the negative polarity in the case of reversal development. As a result, in the case where a photosensitive drum which has a discharging characteristic by a photoconductive effect only when the photosensitive drum is charged in a certain polarity is used, if the potential of the surface of the photosensitive drum is intended to be restored near 0 V, the potential cannot be restored to 0 V when it is charged in the negative polarity in such a manner. For this reason, when the photosensitive drum enters charging process intact, the potential cannot be raised to a value at which a good development can be performed. Resultingly, on the portion of the surface of the photosensitive drum left between the transfer papers, a good electrostatic latent image cannot be formed when the same portion becomes an image part in the next copying.

Also, the second prior art has such deficiency that, for example, when portion charged in the negative polarity is intended to be restored to 0 V by a further charger other than a main charger, the potential of the portion charged in the positive polarity from the beginning, that is, the portion passing through the transferring unit with the transfer paper adhering is raised extraordinarily, and the void white phenomenon, so-called pin hole takes place by a breakdown of the photoconductive layer of that portion. Furthermore, since the further charger other than the main charger is provided, a high-voltage power supply and so on are also required accompanying it, resulting in a high cost of the apparatus.

SUMMARY OF THE INVENTION

Therefore, a principal object of the present invention is to provide an electrographic apparatus capable of obtaining a good image without becoming expensive.

To be brief, an electrographic apparatus in accordance with the present invention, comprises a photosensitive member having a discharging characteristic by a photoconductive effect only when it is charged in a specific polarity, developing means for developing an electrostatic latent image formed on the photosensitive member by toner of the same polarity, a transferring corotron for transferring the toner on the surface of the photosensitive member after toner development onto a transfer paper, and overlap area forming means for forming an overlap area where discharging by discharging means and charging by charging means are performed in an overlapped manner after the transfer by the transferring corotron.

The surface of the photosensitive member is charged, for example, in the positive polarity by the charging means. After toner development, the toner on the surface of the photosensitive member passes through the transferring corotron and is transferred onto the transfer paper by the transferring corotron. Thereafter, the surface of the photosensitive member enters an area where the overlap area forming means works effectively. In the overlap area forming means, charging by the charging means and discharging by the discharging means are performed in an overlapped manner. If the photosensitive member is charged, for example, in the negative polarity, the potential of the surface of the photosensitive member does not return to 0 V even if the discharging means operates, but if the charging means operates at that time, the surface of the photosensitive member is charged, for example, in the positive polarity. Then, since the photosensitive member has a photoconductive effect only when charged in the specific polarity, and therefore the potential of the photosensitive member charged in the positive polarity is reduced by light from the discharging means. Accordingly, thereafter, the normal charging by the charging means is performed.

In accordance with the present invention, the overlap area forming means is provided, and therefore even if the surface of the photosensitive member passes through the transferring corotron in the exposed state with no transfer paper adhering, the potential of the photosensitive member can be restored to a predetermined potential by passing through the overlap area forming means. Consequently, by the charging means, the potential can be raised to the extent that a good development can be performed irrespective of whether or not the surface of the photosensitive member has passed through the transferring corotron in the exposed state. Accordingly, a good development can be performed even if the surface of the photosensitive member is positioned between the transfer papers when passing through the transferring corotron and that portion becomes an image part at the next copying.

Furthermore, the overlap area forming means in accordance with the present invention is not required to be added anew, but can be formed, for example, only by positioning the charging means close to the discharging means, and therefore the apparatus does not become complicated and expensive.

These objects and other objects, features, aspects and advantages of the present invention will become more apparent from the following detailed description of the embodiments of the present invention when taken in conjunction with accompanying drawings.

DESCRIPTION OF THE PREFERRED EMBODIMENTS

Figure 1:
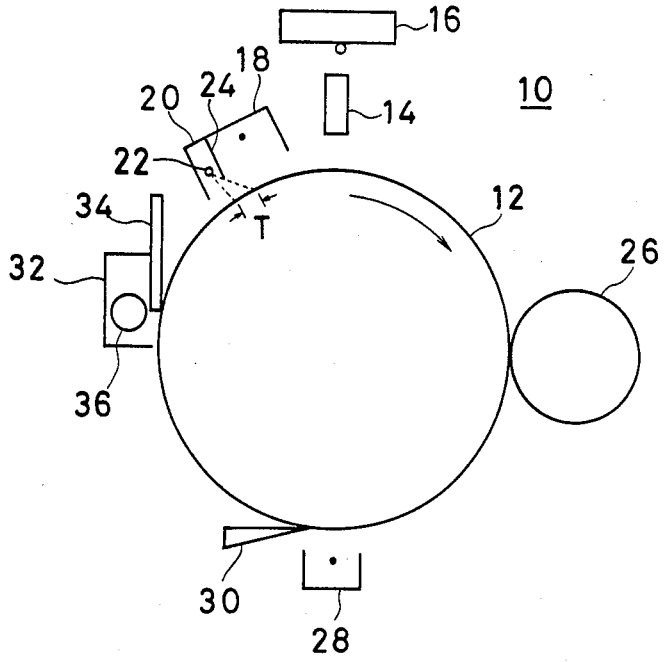
FIG. 1 is an illustrative view of major part showing one embodiment in accordance with the present invention.

FIG. 1 is an illustrative view of major part showing one embodiment in accordance with the present invention. Hereinafter, description is made on the case where the present invention is applied to an electrophotographic copying apparatus, and it is pointed out in advance that electrographic apparatuses whereto the present invention is applied further include printers, facsimiles and the like.

An electrophotographic copying apparatus 10 comprises a photosensitive drum 12, and a copying process is executed by rotating the photosensitive drum 12 in a direction shown by an arrow.

The photosensitive drum 12 has a discharging characteristic by a photoconductive effect only when it is charged in the positive polarity. Accordingly, this apparatus adopts a developing system wherein an electrostatic latent image formed on the surface of the photosensitive drum charged in the positive polarity by toner charged in the same positive polarity in the developing process, that is, a reversal developing system. For the photoconductive layer of such a photosensitive drum 12, Se series or OPC (organized photoconductor) series materials can be utilized.

A short focal distance lens array 14 is installed on the top of the photosensitive drum 12. The short focal distance lens array 14 is composed of a convergent light transmitting unit wherein a large number of rod lenses are disposed closely. Then, the short focal distance lens array 14 converges a light image by selective lighting of LED elements comprised in an LED head 16 installed thereabove, irradiating the light image onto the surface of the photosensitive drum 12.

Upstream from the short focal distance lens array 14 in the direction of rotation of the photosensitive drum 12, a charging corotron 18 for charging uniformly the surface of the photosensitive drum 12, for example, to about 600 V of positive polarity is fixedly installed. Further upstream from it in the direction of rotation, a discharger 20 is installed so as to adjoin the charging corotron 18. A discharging lamp 22 is disposed inside the discharger 20. The photosensitive drum 12 can be discharged by the light of the discharging lamp 22 only when it is charged in the positive polarity.

The light of the discharging lamp 22 is irradiated not only onto an area dedicated to discharge just under the discharger 20 but also onto a charge area under the charging corotron 18. An overlap area T whereto the light of the discharging lamp 22 is also irradiated though it is a charge area under the charging corotron 18, that is, an area where charging and discharging are performed in an overlapped manner is set to 1/5–½ of the whole area charged by the charging corotron 18. The length of this overlap area T is set by the height of a partition plate 24 assuming that the position of mounting the discharging lamp 22 is constant.

Downstream from the short focal distance lens array 14 and in the vicinity of the convergent surface of the photosensitive drum 12, a developing device 26 for developing an electrostatic latent image by toner is installed. The developing device 26 causes toner charged in the positive polarity to adhere to an electrostatic latent image formed by positive charge, thereby developing the electrostatic latent image as a toner image.

More specifically, the toner charged in the positive polarity adheres to the portion irradiated by the light of the LED elements of the LED head 16, that is, the portion whose surface potential is nearly 0 V of the electrostatic latent image formed on the photosensitive drum 12 by an action of developing bias of the same positive polarity.

Further downstream from the developing device 26 and in the vicinity of the peripheral side surface of the photosensitive drum 12, a transferring corotron 28 is installed. The transferring corotron 28 gives negative charge by discharging to transfer the toner image developed by the developing device 26.

Downstream from the transferring corotron 28 and in the vicinity of the peripheral side surface of the photosensitive drum 12, a separating claw 30 for peeling the transfer paper after transfer from the surface of the photosensitive drum 12 is installed. The tip of the separating claw 30 contacts with the surface of the photosensitive drum 12 as shown in FIG. 1 when the transfer paper is to be peeled off.

Downstream from the separating claw 30 and in the vicinity of the peripheral side surface of the photosensitive drum 12, a cleaning device 32 is installed. The cleaning device 32 removes the toner remaining on the surface of the photosensitive drum 12 without being transferred onto the transfer paper. This means that the cleaning device 32 collects the residual toner scraped off by a blade 34, for example, in a waste toner container (not illustrated) by a screw conveyer 36.

Figure 2:
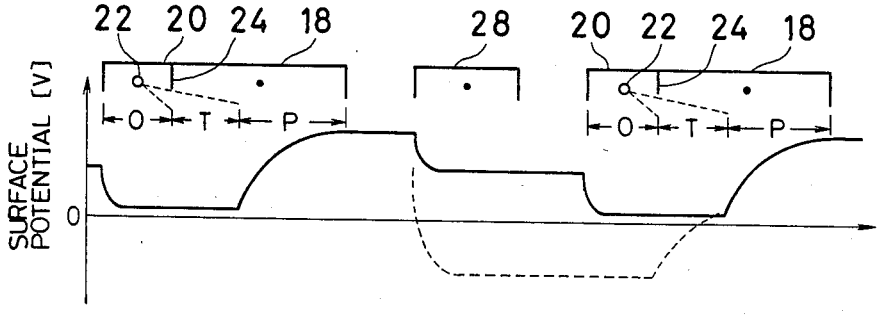
FIG. 2 is a graph showing surface potential of a photosensitive drum of FIG. 1 embodiment.

In operation, when the surface of the photosensitive drum 12 whereto the transfer paper adheres passes through just above the transferring corotron 28, as shown by a solid line in FIG. 2, the potential of the surface of the photosensitive drum 12 is reduced to about ⅔ by discharge of the transferring corotron 28. Thereafter, when the surface of the photosensitive drum 12 comes just under the discharger 20, the potential of the photosensitive drum 12 is further reduced, becoming nearly 0 V while some positive potential is held. This potential of the surface of the photosensitive drum 12 does not vary even when the surface of the photosensitive drum 12 enters the overlap area T. When the surface of the photosensitive drum 12 passes through the overlap area T and then enters a charge-dedicated area P where only charing of the charging corotron 18 is performed, the surface potential is raised gradually, and at the end of the charge-dedicated area P, the potential rises to a predetermined value of about 600 V.

Next, when the surface of the photosensitive drum 12 passes through just above the transferring corotron 28 with no transfer paper adhering thereto, the potential of that portion of the surface of the photosensitive drum 12 becomes negative as shown by a dotted line in FIG. 2. This means that when the surface of the photosensitive drum 12 passes through just above the transferring corotron 28, it is given negative charge from the transferring corotron 28. As a result, the surface potential of the portion with no transfer paper becomes negative.

When the surface of the photosensitive drum 12 is carried intact in the state of negative surface potential just under the discharger 20 according to the rotation of the photosensitive drum 12, no change in the potential takes place in a discharge-dedicated area 0. However, when the portion of negative surface potential enters the overlap area T, the surface potential is increased gradually by discharging of the charging corotron 18. Then, when it completely passes through the overlap area T, the potential thereof is raised to the same value as in the case of passing through just above the transferring corotron 28 with the transfer paper adhering, that is, to a positive value near 0 V as shown by the solid line. Consequently, when the surface of the photosensitive drum 12 enters the charge-dedicated area P, the surface potential of the photosensitive drum 12 is raised following the same locus as in the previous case.

As described above, by forming the overlap area where charging and discharging area performed at the same time in an overlapped manner, the potential of the surface of the photosensitive drum 12 can be raised to a predetermined value in the charge-dedicated area P even for the portion passing through just above the transferring corotron 28 with no transfer paper adhering. Accordingly, even if that portion becomes an image forming part at the next copying, a good development can be performed by the developing device 26.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An electrophotographic apparatus comprising:

a photosensitive member having a discharging characteristic by a photoconductive effect only when it is charged in a specific polarity, developing means for developing an electrostatic latent image formed on said photosensitive member by toner of the same polarity, a transferring corotron for transferring the toner on the surface of said photosensitive member after toner development onto a transfer paper, and overlap area forming means for forming an overlap area where discharging by a discharging means and charging by a charging means are performed in an overlapped manner after transferring by said transferring corotron.

2. An electrophotographic apparatus in accordance with claim 1, wherein said discharging means includes a discharging light source, and in said overlap area, part of light of said discharging light source is irradiated onto a charge area where the charging means works effectively.

3. An electrophotographic apparatus in accordance with claim 2, wherein said photosensitive member is formed so that the surface thereof moves in a certain direction, and said discharging light source is disposed upstream from said charging means in the direction of movement of the surface of said photosensitive member.

4. An electrophotographic apparatus in accordance with claim 3, wherein said overlap area forming means includes a common cover, said discharging light source disposed in said common cover, a charging corotron disposed in the common cover and downstream in said direction of movement, and a partition which is disposed between said discharging light source and said charging corotron and is formed so that part of light of said discharging light source leaks to an area charged by said charging corotron.

* * * * *